US009249586B2

(12) United States Patent
Wood

(10) Patent No.: US 9,249,586 B2
(45) **Date of Patent: *Feb. 2, 2016**

(54) TILE INSTALLATION GUIDE AND RELATED METHOD

(71) Applicant: Timothy J. Wood, Wynantskill, NY (US)

(72) Inventor: Timothy J. Wood, Wynantskill, NY (US)

(73) Assignee: Timothy J. Wood, Wynantskill, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/172,359

(22) Filed: Feb. 4, 2014

(65) Prior Publication Data

US 2015/0113910 A1 Apr. 30, 2015

Related U.S. Application Data

(63) Continuation of application No. 14/063,661, filed on Oct. 25, 2013.

(60) Provisional application No. 61/767,355, filed on Feb. 21, 2013.

(51) Int. Cl.

| | |
|---|---|
| ***E03D 11/16*** | (2006.01) |
| ***E04F 21/00*** | (2006.01) |
| ***E04F 21/22*** | (2006.01) |

(52) U.S. Cl.

CPC ..... *E04F 21/0076* (2013.01); *E03D 11/16* (2013.01); *E04F 21/22* (2013.01)

(58) Field of Classification Search

CPC ..... E03D 11/16; E04F 21/0076

USPC ..... 4/252.4–252.6; 52/747.11

See application file for complete search history.

(56) References Cited

U.S. PATENT DOCUMENTS

| | | | | | |
|---|---|---|---|---|---|
| 60,153 | A * | 12/1866 | Diven | 4/252.4 |
| 2,479,837 | A * | 8/1949 | Hollaender | 285/60 |
| 3,419,288 | A * | 12/1968 | Logsdon | 285/58 |
| 3,896,510 | A * | 7/1975 | O'Connell | 4/252.1 |
| 4,780,915 | A * | 11/1988 | Cuschera | 4/252.4 |
| 5,246,255 | A * | 9/1993 | Forbes et al. | 285/24 |
| 5,608,922 | A * | 3/1997 | Lewis | 4/251.1 |
| 6,094,752 | A * | 8/2000 | Loshaw | 4/252.1 |
| 6,581,214 | B1 * | 6/2003 | Love et al. | 4/252.2 |
| 7,805,777 | B2 | 10/2010 | Hughes | |
| 8,099,801 | B2 * | 1/2012 | Hughes | 4/252.5 |
| 8,196,229 | B1 * | 6/2012 | Hickok | 4/288 |
| 8,281,421 | B2 | 10/2012 | Hughes | |
| 2005/0283889 | A1 * | 12/2005 | Flushing | 4/252.1 |
| 2011/0131715 | A1 * | 6/2011 | Culwell | 4/252.5 |
| 2011/0209278 | A1 * | 9/2011 | Hatt | 4/252.5 |
| 2012/0240319 | A1 | 9/2012 | Yssel | |
| 2013/0219603 | A1 | 8/2013 | Wendorff | |

OTHER PUBLICATIONS

Plummer, Notice of Allowance and Fee(s) Due for U.S. Appl. No. 14/063,661 dated Apr. 16, 2015, 11 pages.

Plummer, Office Action Communication for U.S. Appl. No. 14/063,661 dated Feb. 3, 2015, 13 pages.

* cited by examiner

*Primary Examiner* — Elizabeth A Plummer

(74) *Attorney, Agent, or Firm* — Hoffman Warnick LLC

(57) ABSTRACT

Various embodiments provide apparatuses and methods for installing tile with a tile installation guide. In some embodiments, an apparatus includes a tile installation guide including a guide body having a polygonal outer surface and an opening configured to surround a non-polygonal element, wherein a thickness of the guide body is substantially equivalent to a thickness of a tile for which the guide is used.

18 Claims, 7 Drawing Sheets

TILE INSTALLATION GUIDE AND RELATED METHOD

This application is a continuation of co-pending U.S. patent application Ser. No. 14/063,661, filed Oct. 25, 2013, which is incorporated herein by reference in its entirety for all that it contains in order to provide continuity of disclosure and which claims priority to U.S. Provisional Patent Application No. 61/767,355, filed Feb. 21, 2013.

TECHNICAL FIELD

The subject matter disclosed herein relates generally to tile installation hardware. More particularly, the subject matter disclosed relates to tile installation guides for use when installing tile on a non-uniform surface and methods of their use.

BACKGROUND

Tiling a non-uniform surface is challenging, even for an experienced tiler. Tiling may be particularly challenging when tiling around a non-polygonal element, such as a toilet flange in a floor. While there are many different types of toilet flanges, all standard flanges are circular and about seven inches across. Generally, it is necessary to measure tiles and to determine where to cut the tiles to fit snugly around the toilet flange in order to leave an opening for installation of the toilet and to leave no margins between the installed tiles and the perimeter of the base of the installed toilet. In general, once the location of the toilet flange is located relative to the tiles used for installation, the installer will use a grinder or a nipping tool to create curved edges in the tiles. Such grinding and nipping takes time and requires eye protection.

Also, the measurements necessary to shape the tile take time and some guess work is required. Consequently, mistakes are easy to make while tiling. When tiling around a toilet flange, an installer generally plugs the drain in order to keep construction debris from going down the sewer pipe, which would potentially cause a future blockage.

BRIEF DESCRIPTION

Apparatuses and methods for use in tile installation are disclosed. A first aspect provides tile installation guide comprising a guide body having a polygonal outer surface and an opening configured to surround a non-polygonal element.

A second aspect provides a method of installing tiles comprising: placing a guide body having a polygonal outer surface and an opening therein around a non-polygonal element positioned within a surface to be tiled, the opening sized to surround the non-polygonal element; aligning the polygonal outer surface of the guide body with an intended tile orientation; affixing the guide body to the surface; and installing tiles about the guide body.

A third aspect provides a tile installation guide comprising: a guide body having a polygonal outer surface and an opening configured to surround a non-polygonal element, wherein a thickness of the guide body is substantially equivalent to a thickness of a tile for which the guide is used.

A fourth aspect provides a tile installation guide comprising: a guide body having an outer surface that defines a segment of a polygon and an opening configured to surround a segment of a non-polygonal element.

A fifth aspect provides a method of installing at least one tile comprising: placing a guide body adjacent a non-polygonal element positioned within a surface to be tiled, the guide body including an outer surface that defines a segment of a polygon, the guide body defining an opening configured to surround a segment of the non-polygonal element and the guide body having a thickness substantially equivalent to a thickness of a tile for which the guide is used; aligning the polygonal outer surface of the guide body with an intended tile orientation; affixing the guide body to the surface; and installing at least one tile about the guide body.

BRIEF DESCRIPTION OF THE DRAWINGS

These and other features of this invention will be more readily understood from the following detailed description of the various aspects of the invention taken in conjunction with the accompanying drawings that depict various embodiments, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The subject matter disclosed herein relates generally to tile installation hardware. More particularly, the subject matter disclosed relates to tile installation guides for use when installing tile on a non-uniform surface and a related method.

Various aspects of the invention provide for tile installation guides for use when installing tiles over a non-uniform surface. An example of a non-uniform surface includes a floor with a toilet flange. As discussed above, tiling a floor with a toilet flange has its challenges; however, many of such challenges may be overcome by using tile installation guides and methods of their use according to embodiments described herein. Use of a tile installation guide according to embodiments may reduce or may even obviate the need to measure tiles in order to determine where to cut the tiles to fit properly around an object such as a toilet flange. Embodiments of the invention allow for the installation of uncut tiles, or tiles with only straight cuts made to them. Use of such straight-cut tiles or uncut tiles reduces guess work and many possible mistakes during tile installation. Also, when using a tile installation guide according to embodiments when tiling around a toilet flange, an installer no longer needs to plug the drain in order to keep construction debris from going down the sewer pipe, potentially causing a future blockage. Plugging of the drain pipe is unnecessary, as embodiments provide for a removably attached membrane covering an opening in the guide body and therefore covering the drain during tile installation.

Figure 1:
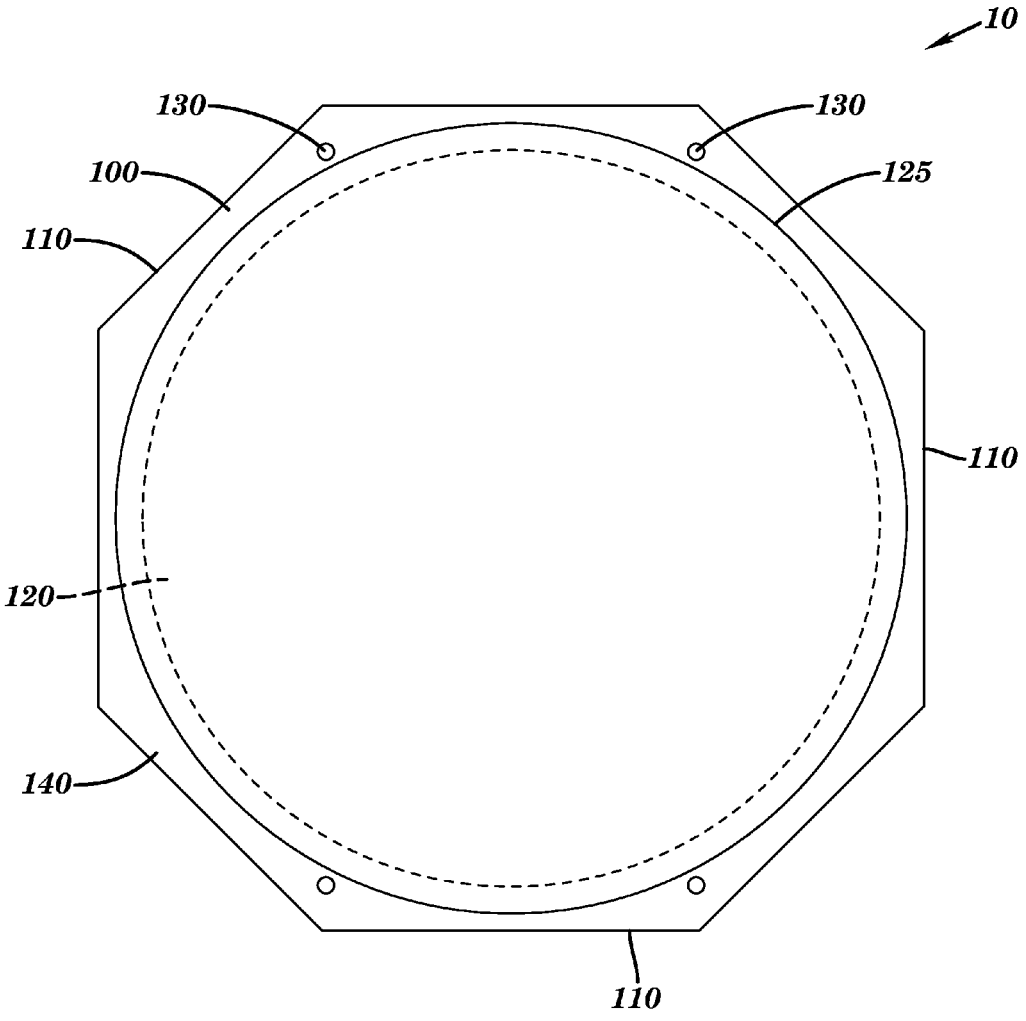
FIG. 1 shows a plan view of a tile installation guide according to embodiments.

Turning now to FIG. 1, a plan view illustrating a tile installation guide 10 according to embodiments is shown. Tile installation guide 10 includes a guide body 100 having a polygonal outer surface 110 and an opening 120 (shown in phantom) configured to surround a non-polygonal element (non-polygonal element not shown). A non-polygonal element may include a toilet flange which may be substantially circular. According to embodiments where the non-polygonal element is circular or substantially circular (e.g., a toilet flange), opening 120 may be substantially circularly shaped. However, opening 120 may be shaped differently than circular, e.g., oval-shaped or another non-polygonal shape. "Substantially circular" is intended to describe shapes that are circular or are not exactly circular, but have an outer circumference that deviates from a circular circumference by 5-15 percent.

FIG. 1 further illustrates a membrane 125 removably affixed to guide body 100 to cover opening 120 (shown in phantom with dashed lines). Membrane 125 may include information on it, such that it acts as a label. While membrane 125 is illustrated as being circular, membrane 125 may take any shape appropriate to cover opening 120. Membrane 125 may be made of paper, plastic or any appropriate material. Membrane 125 may be coated with, for example, a pressure sensitive adhesive on the surface that contacts guide body 100. The adhesive may cover the entire contacting surface, or the adhesive may cover only that portion of the membrane 125 that is affixed to guide body 100. Membrane 125 may be left affixed to guide body during tile installation in order to prevent construction debris from falling into opening 120 and into or onto a non-polygonal element therein, such as plumbing pipe drain. Membrane 125 may further be removed from guide body 100 after completion of tile installation and prior to installation of any hardware to be placed on top of guide body 100, for example, a toilet.

FIG. 1 further illustrates that guide body 100 may optionally include a plurality of fastener openings 130 sized to accept fasteners for fastening the guide body 100 to a surface adjacent the non-polygonal element (fasteners and surface not shown). According to embodiments, fastener openings 130 may extend at least part way through the body 100, from a surface 140 of guide body 100. While not illustrated in FIG. 1, fastener openings 130 may extend all the way through guide body 100. The fasteners used with openings 130 may include any now known or later developed fasteners such as screws, nails, etc., appropriate for the material beneath the tiles.

Guide body 100 may be made of any appropriate material including, but not limited to aluminum, polypropylene or polyvinyl chloride, stainless steel, powder-coated stainless steel, or Acrylonitrile Butadiene Styrene (ABS). Such materials may include recycled materials, such as recycled polypropylene.

Figure 2:
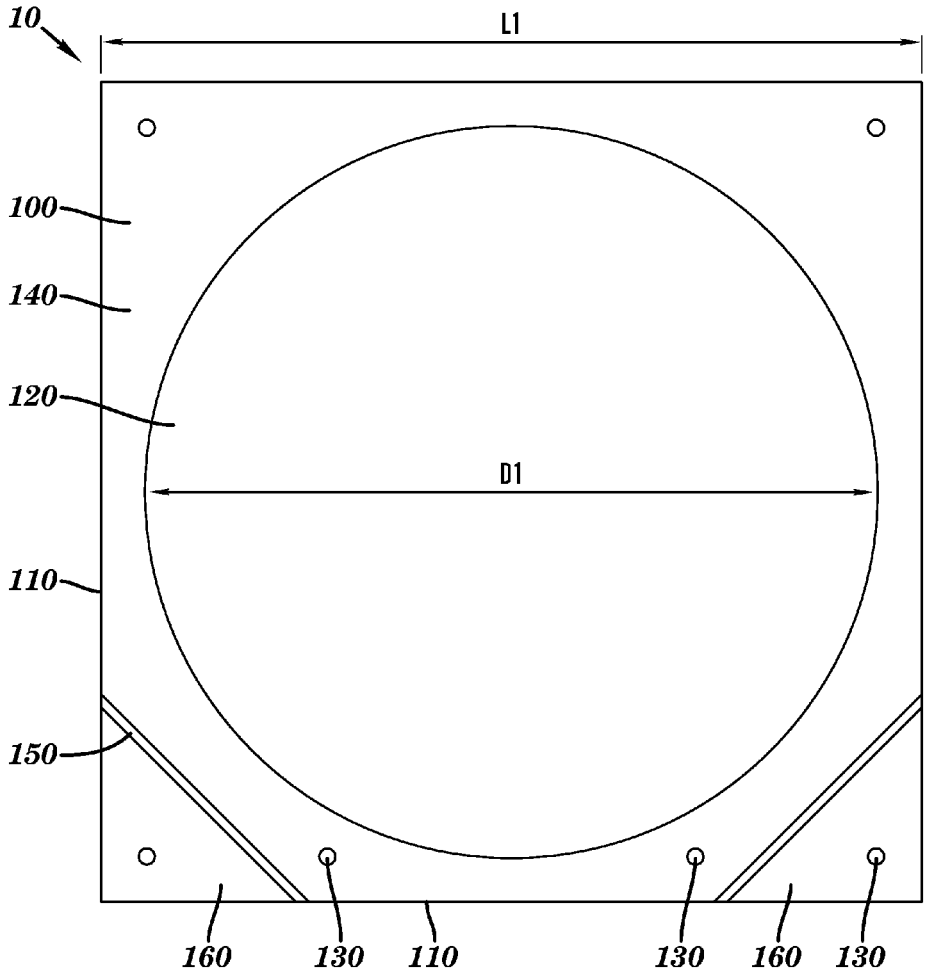
FIG. 2 shows a plan view of a tile installation guide according to various embodiments.

While guide body 100 is illustrated in FIG. 1 with a polygonal surface 110 having eight sides, it should be understood that embodiments may have polygonal surfaces 110 with fewer or more than eight sides. According to some embodiments, guide body 100 may have a polygonal outer surface 110 that includes a plurality of sides that are orthogonal to one another. For example, FIG. 2 illustrates guide body 100 including four sides of equal length, i.e., in the form of a square.

According to embodiments, guide body 100 may include breakable channels 150 configured to allow removal of a portion 160 of the guide body 100. In this fashion, the number of sides can be adjusted to accommodate different situations. FIG. 2 illustrates two triangularly-shaped guide body portions 160 which may be removed by breaking breakable channels 150. According to embodiments, each breakable channel 150 may extend from one of the sides to an adjacent side (i.e., adjacent sides include polygonal surfaces 110), as illustrated in FIG. 2. Alternative embodiments may include breakable tabs, rather than channels, that break away so that portion 160 may be removed. Although two breakable channels 150 have been illustrated, it is understood that more or fewer channels 150 may be provided, e.g., four may be provided such that the guide body in FIG. 2 can be selectively made to look like that of FIG. 1.

According to embodiments, guide body 100 may be substantially square. Also according to embodiments, a substantially square guide body 100 may have a side length L1 of, for example, approximately 8 inches and a substantially circular opening with a diameter D1 of, for example, approximately 7.25 inches. The diameter D1 of approximately 7.25 inches is chosen to be used with a standard toilet flange; however, other diameters are considered part of this disclosure so that embodiments may be used with other-than-standard toilet flanges or non-polygonal elements having different dimensions wherein diameter D1 may be between about 6.8 inches and 7.5 inches.

Figure 3:
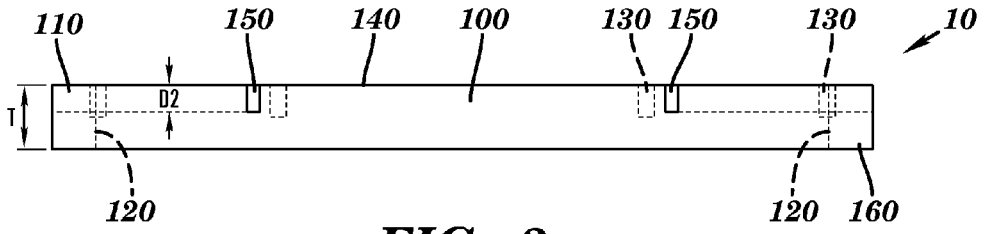
FIG. 3 shows a side view of a tile installation guide according to various embodiments.

Referring now to FIG. 3, a side view of tile installation guide 10 guide body 100 with breakable channels 150, fastener openings 130 and opening 120 (in phantom) is illustrated. According to embodiments, breakable channel 150 may have a depth D2 that is at least one quarter a thickness T of guide body 100, as illustrated in FIG. 3. Depth D2 may be seven eights the thickness T of guide body 100 allowing for cutting through the material of guide body 100, at breakable channel 150, with a utility knife or other sharp object. Also according to embodiments, and as discussed above with respect to FIG. 1, fastener openings 130 may extend at least part way through the body, from a surface 140 of guide body 100. Fastener openings 130 are shown in dotted line to indicate that they do not necessarily contact polygonal surfaces 110, but extend from surface 140 into guide body 100. According to embodiments, thickness T of guide body 100 may be substantially equivalent to thickness T of a tile for which the guide is used. "Substantially equivalent" when referring to thickness T means a thickness between eighty-five percent to one hundred fifteen percent of the thickness of the tile for which the guide is intended. According to embodiments, thickness T may be about one quarter of an inch, three eights of an inch or three quarters of an inch; however, such thicknesses are merely illustrative and other thicknesses are contemplated.

Figure 4:
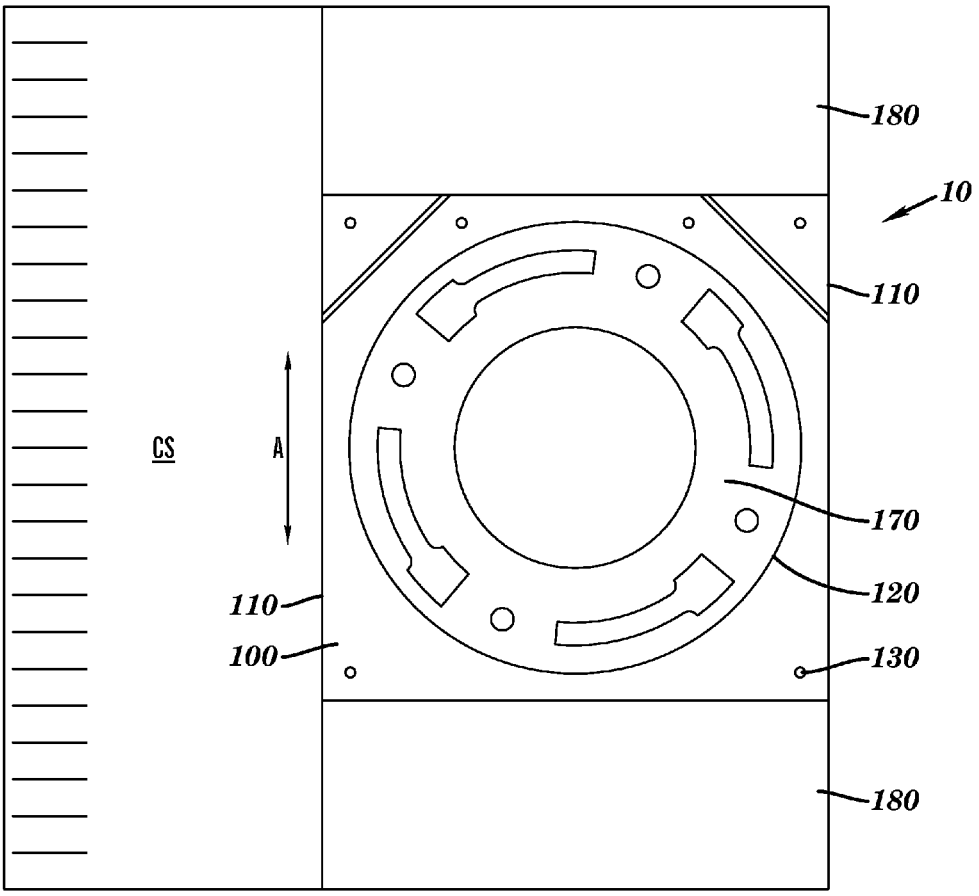
FIG. 4 shows a plan view of a tile installation guide in use according to various embodiments.

FIG. 4 shows a plan view of tile installation guide 10 in use according to various embodiments. In FIG. 4, toilet flange 170 is located between tiles 180. A carpenter's square CS is illustrated lined up with intended tile orientation A and abutting polygonal outer surface 110 of guide body 100. While not illustrated, carpenter's square CS is intended to be lined up with a wall that is orthogonal to intended tile orientation A.

In operation, a user places a guide body having a polygonal outer surface 110 and an opening 120 therein, around a non-polygonal element positioned within a surface to be tiled, the opening 120 is configured to surround the non-polygonal element. Such placement is illustrated in FIG. 4. Also, as discussed above, with respect to FIG. 1, a non-polygonal element may be a toilet flange; however, the use of the tile installation guide 10 with other non-polygonal elements is within the scope of this invention.

As an optional step, prior to placing guide body 100, a portion 160 of guide body 100 may be removed to change the number of sides of the polygonal outer surface 110. As an example, the removal of two portions 160 of guide body 100 may be performed so that two corners of guide body 100 are not visible after installation of a toilet having a small base. That is, standard toilets may fit over a toilet flange and an eight-inch, square tile installation guide 10 such that only tile is visible at the margins of the bottom of the toilet. However, some toilets do not have large enough bases to completely cover a tile installation guide 10 unless portions 160 of the guide body 100 are removed.

A user then aligns the polygonal outer surface 110 of the guide body 100 with an intended tile orientation A. Aligning may be performed using a carpenter's square with a leg of the square held along a nearby wall; the other leg being used to align a polygonal outer surface 110 of the guide. The aligning leg is illustrated in FIG. 4, abutting a polygonal outer surface 110 of guide body 100, however the other leg of the carpenter's square is not shown. Intended tile orientation A is illustrated in FIG. 4. As understood, the aligning may be provided in a variety of fashions, e.g., by eye, alignment with previously placed tiles, etc.

Guide body 100 may then be affixed to the surface to be tiled using an appropriate means, including with the use of fasteners applied through the guide body fastener openings 130, as discussed above with respect to FIG. 1. Affixing guide body 100 to the surface may also be performed with the use of cement, either alone, or in addition to the use of fasteners applied through fastener openings 130.

After guide body 100 is affixed to the surface, tiles are installed about guide body 100. Tiles may be installed by any appropriate method now known or later developed. It is intended that tiles will be installed with at least one side aligned with intended tile orientation A, as illustrated in FIG. 4.

Figure 5:
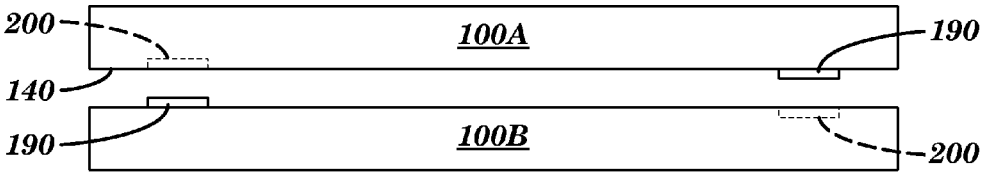
FIG. 5 shows a side view of a pair of tile installation guides according to various embodiments.
Figure 6:
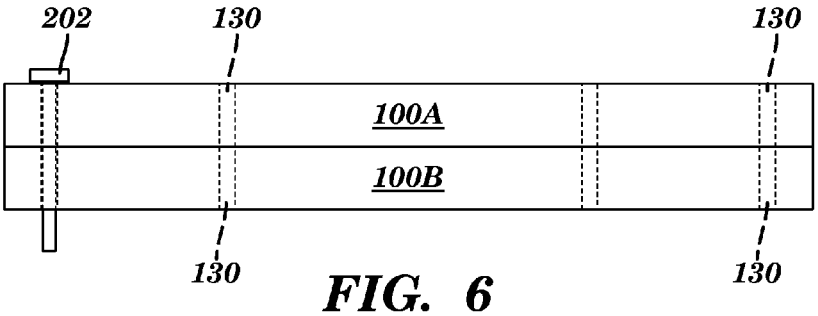
FIG. 6 shows a side view of stacked tile installation guides according to various embodiments.

Referring to FIGS. 5 and 6, when a surface of the tiles used is above a surface of tile guide body 100, i.e., when installing tiles that are thicker than guide body 100, guide bodies 100A, B may be stacked. That is, a first guide body 100A may be stacked on top of another guide body 100B, the other guide body 100B being substantially identical to the first guide body 100A. FIGS. 5 and 6 illustrate two options for stacking identical guide bodies 100A, B. In FIG. 5, faces of guide bodies 100 having stacking structures 190, 200 that are mated with one another, as shown. In one embodiment, stacking structures may include raised area (e.g., bumps) 190 and mating grooves 200. Raised areas 190 on surface 140 of one guide body mate with grooves 200 on surface 140 of an adjacent guide body to align the guide bodies. Mating structures 190, 200 may take a variety of other forms. Guide bodies 100A and/or 100B may be flipped to accommodate mating structures 190, 200. Although the guide bodies 100A, 100B are preferably identical, that may not be necessary in all cases as one of the guide bodies may be formed differently for a particular position relative to the other.

In FIG. 6, fastener openings 130 of the stacked guide bodies 100A, B are aligned with one another, allowing for fasteners to be placed through both bodies 100A, B at once and thereby aligning guide bodies 100 A, B with one another. A user may align one or both guide bodies 100A, B with the desired tile orientation A. Alignment may be performed by an appropriate means, for example a carpenter's square as described above. Finally, a user may affix at least one or more of the guide bodies 100A, B to the surface to be tiled. Affixing a guide body 100A, B may be performed using cement, glue, double sided tape or any other appropriate means, including the use of fasteners 202 (one shown) applied through aligned fastener openings 130 as illustrated in FIG. 6.

Figure 7:
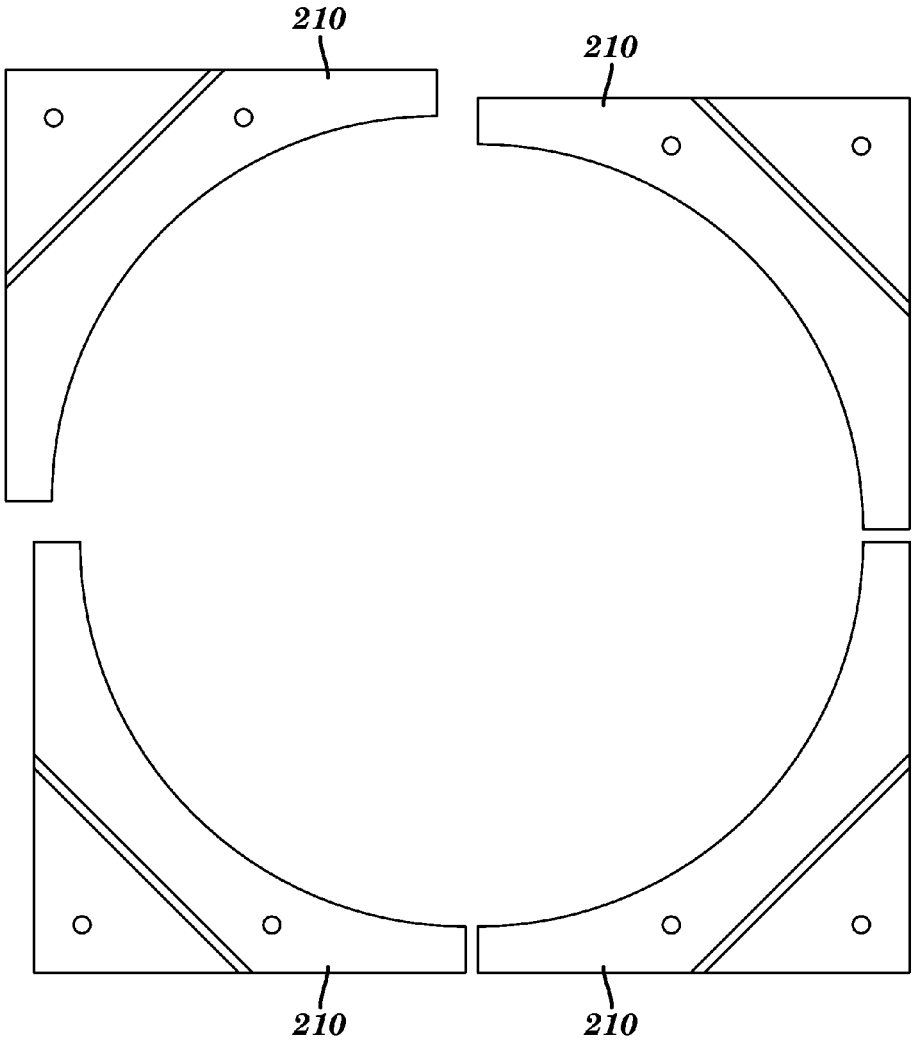
FIG. 7 shows a plan view of a segmented tile installation guide according to various embodiments.

FIG. 7 illustrates a plan view of a segmented tile installation guide according to embodiments. In such an embodiment, tile installation guide 210 may include a guide body having an outer surface 110 that defines a segment of a polygon and an opening configured to surround a segment of a non-polygonal element. According to some embodiments, the outer surface of guide body 210 may define a right angle, as shown in FIG. 7. In FIG. 7, a plurality of guide body segments 210 is illustrated. It is envisioned that identical, non-square and non-polygonal guide body segments 210 may be used to align tile(s). In such embodiments, a method of installing at least one tile may include placing a guide body 210 adjacent a non-polygonal element and placing another guide body 210 adjacent the non-polygonal element, the another guide body 210 being substantially identical to the first guide body 210. According to such methods according to embodiments, the outer surface of the another guide body 210 may be aligned with the intended tile orientation, as the first guide body 210 may be so aligned. Also according to embodiments, both the first and the another guide bodies 210 may be affixed to a surface to be tiled. If two adjacent guide body segments 210 are affixed to a surface to be tiled, such that each segment 210 is appropriately attached at a single attachment point and a tile is placed to abut side surfaces 110 of both guide body segments 210, the tile will be aligned with a desired tile alignment direction A (as shown in FIG. 4), as long as the guide body segments 210 are initially aligned with that desired orientation A. Guide body segments 210 may be stacked, as discussed above, for use with thick tiles.

Figure 8:
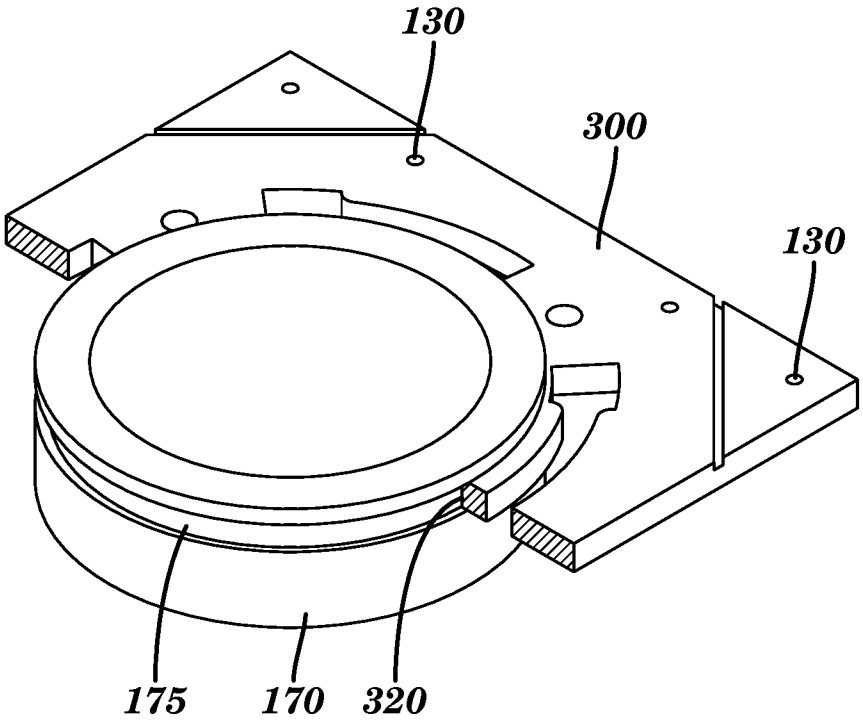
FIG. 8 shows a three dimensional perspective view illustrating a tile installation guide interlocking with a toilet flange according to various embodiments of the invention.

FIG. 8 shows a three-dimensional, cross-sectional view of a tile installation guide according to embodiments. As understood, a standard toilet flange 170 may have a circular channel 175 in its outer perimeter, which provides an attachment point for accessories. Guide body 300 is shown in cut-away to illustrate that an opening 320 of guide body 300 may be sized to fit over and operationally couple with outer perimeter channel 175 of toilet flange 170. Such optional fitment may allow guide body 300 to snap onto a toilet flange 170 and to be freely revolvable about an axis at the middle of the flange opening, e.g., about a drain. Such freedom of movement may allow for easier alignment of tile installation guide body 300 prior to tiling a floor. Opening 320 of guide body 300 may define an inner circumference that allows for guide body 300 to operatively couple with an outer perimeter of a toilet flange 170. In such an optional embodiment, opening 320 may have a diameter of, for example, approximately 6.9 inches in order to allow guide body 300 to snap into the channel 175 of a standard toilet flange 170 with an outer perimeter of about 7.0 inches. This snapping-on of guide body 300 may be accomplished because a material of guide body 300 and or of toilet flange 170 may stretch or deform enough to allow for operative coupling as described. The dimensions discussed are merely illustrative and other dimensions are contemplated to be within the scope of embodiments according to the invention.

Figure 9:
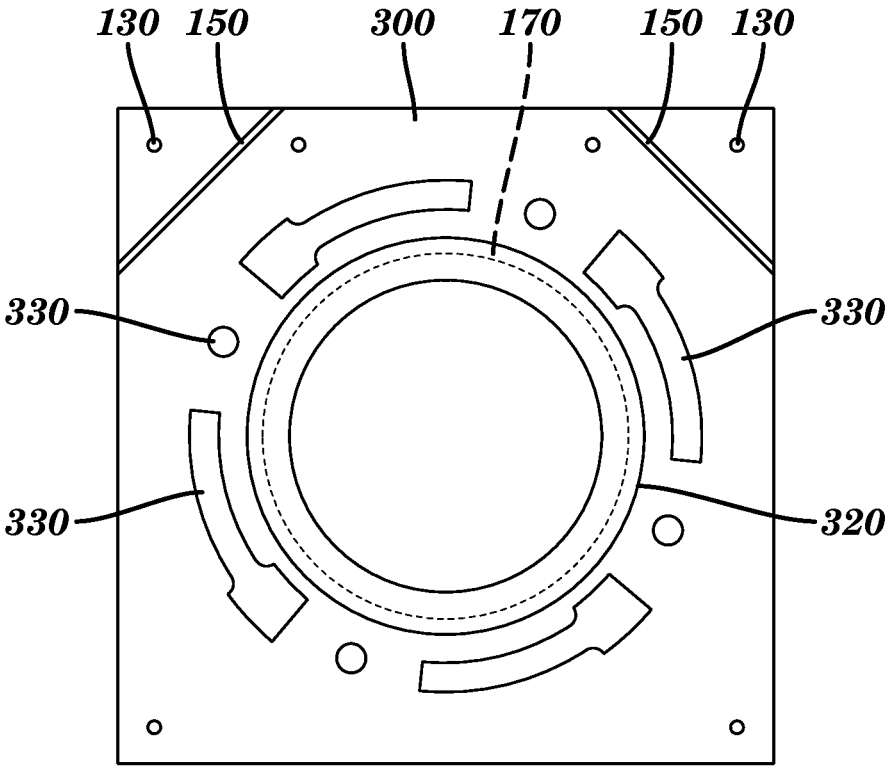
FIG. 9 shows a plan view of a tile installation guide and toilet flange according to various embodiments.

FIG. 9 shows a plan view of guide body 300 with opening 320 configured to operationally couple with outer perimeter channel 175 (channel 175 shown in FIG. 8) in a standard toilet flange 170 as discussed above with respect to FIG. 8. Guide body 300 may include breakable channels 150 and may include a plurality of attachment openings 130. Guide body 300 may further include attachment apertures 330 so that a toilet may be installed directly onto guide body 300 and attached to a surface, such as a floor. It is contemplated that embodiments of guide body 300 having attachment apertures 330 may be made of a material including stainless steel or one or more other metals or alloys, however other materials as described above are within the scope of the inventive concepts.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A tile installation guide comprising:

a guide body having a polygonal outer perimeter; and an opening extending through the guide body and configured to surround a non-polygonal element, wherein the guide body includes a set of segments, each segment including a curved inner surface and an angled outer surface, the curved inner surfaces of each segment collectively defining the opening and the angled outer surfaces of each segment collectively defining the polygonal outer perimeter, wherein at least one segment in the set of segments further includes a breakable channel configured to allow removal of a portion of the at least one segment such that a shape of the polygonal outer perimeter is changed while a shape of the opening is maintained.

2. The tile installation guide of claim 1, wherein the breakable channel has a depth at least one quarter a thickness of the guide body.

3. The tile installation guide of claim 1, wherein the guide body includes a material chosen from the group consisting of: aluminum, polypropylene, stainless steel, powder-coated stainless steel, acrylonitrile butadiene styrene or polyvinyl chloride.

4. The tile installation guide of claim 1, wherein a thickness of the guide body is between about one quarter of an inch and three quarters of an inch.

5. The tile installation guide of claim 1, wherein the guide body is substantially square with a side length of approximately 8 inches and the opening is substantially circular with a diameter of approximately 7.5 inches.

6. The tile installation guide of claim 1, further comprising a plurality of alignment members configured to allow a plurality of the guide bodies to be stacked upon one another in an aligned fashion.

7. The tile installation guide of claim 1, wherein the opening is configured to operationally couple with a channel in a perimeter of the non-polygonal element.

8. A tile installation guide comprising:

a guide body having an outer perimeter that defines a polygon; and an opening extending through the guide body and configured to surround a segment of a non-polygonal element, wherein a thickness of the guide body is substantially equivalent to a thickness of a tile for which the guide is used, wherein the guide body includes a set of segments, each segment including a curved inner surface and an angled outer surface, the curved inner surfaces of each segment collectively defining the opening and the angled outer surfaces of each segment collectively defining the outer perimeter, wherein at least one segment in the set of segments further includes a breakable channel configured to allow removal of a portion of the at least one segment such that a shape of the outer perimeter is changed while a shape of the opening is maintained.

9. The tile installation guide of claim 8, wherein the breakable channel has a depth at least one quarter the thickness of the guide body.

10. The tile installation guide of claim 8, wherein the thickness of the guide body is between about one quarter of an inch and three quarters of an inch.

11. The tile installation guide of claim 8, wherein the outer perimeter defines a right angle.

12. The tile installation guide of claim 8, wherein the guide body includes a material chosen from the group consisting of: aluminum, polypropylene, stainless steel, powder-coated stainless steel, acrylonitrile butadiene styrene or polyvinyl chloride.

13. A method of installing at least one tile comprising:

placing a guide body adjacent a non-polygonal element positioned within a surface to be tiled, the guide body including an outer perimeter that defines a polygon, the guide body defining an opening extending through the guide body configured to surround a segment of the non-polygonal element and the guide body including set of segments, each segment including a curved inner surface and an angled outer surface, the curved inner surfaces of each segment collectively defining the opening and the angled outer surfaces of each segment collectively defining the outer perimeter;

removing a portion of at least one segment in the set of segments such that a shape of the outer perimeter is changed while a shape of the opening is maintained;

aligning the polygonal outer perimeter of the guide body with an intended tile orientation;

affixing the guide body to the surface; and installing the at least one tile about the guide body.

14. The method of claim 13, wherein the guide body includes at least a first guide body and a second guide body, the method further comprising:

stacking the second guide body on the first guide body, the second guide body being substantially identical to the first guide body;

aligning the second guide body with the intended tile orientation; and affixing the second guide body to the first guide body, wherein the first guide body and the second guide body collectively have a thickness that is substantially equal to a thickness of the at least one tile to be installed.

15. The method of claim 13, wherein the affixing of the guide body to the surface includes cementing the guide body to the surface.

16. The method of claim 13, wherein the guide body includes an outer surface that defines a polygon and wherein the opening is sized to surround the non-polygonal element.

17. The method of claim 13, wherein the guide body includes an outer surface that defines a polygon and wherein the opening is configured to operationally couple with a channel in a perimeter of the non-polygonal element, the method further comprising:

operationally coupling the opening with the channel in the perimeter of the non-polygonal element.

18. The method of claim 13, wherein the placing the guide body around the non-polygonal element includes attaching a first segment, a second segment, a third segment, and a fourth segment to the surface to be tiled.

* * * * *